US009167908B1

(12) United States Patent
Anthony et al.

(10) Patent No.: US 9,167,908 B1
(45) Date of Patent: Oct. 27, 2015

(54) REPLACEABLE SHROUD FOR AN ADJUSTABLE BED

(71) Applicant: Hickory Springs Manufacturing Company, Hickory, NC (US)

(72) Inventors: Richard Anthony, Hickory, NC (US); Timothy Witherell, Hickory, NC (US); Matthew Reiter, Hickory, NC (US)

(73) Assignee: HICKORY SPRINGS MANUFACTURING COMPANY, Hickory, NC (US)

( * ) Notice: Subject to any disclaimer, the term of this patent is extended or adjusted under 35 U.S.C. 154(b) by 0 days.

(21) Appl. No.: 14/455,691

(22) Filed: Aug. 8, 2014

Related U.S. Application Data

(60) Provisional application No. 61/864,149, filed on Aug. 9, 2013, provisional application No. 61/921,671, filed on Dec. 30, 2013.

(51) Int. Cl.
*A47C 19/02* (2006.01)
*A47C 19/04* (2006.01)

(52) U.S. Cl.
CPC ..... *A47C 19/045* (2013.01); *A47C 19/021* (2013.01); *A47C 19/02* (2013.01)

(58) Field of Classification Search
CPC ..... A47C 19/045; A47C 21/06; A47C 31/00; A61G 2007/052; A61G 2007/0521; A61G 2007/0522
USPC ..... 5/620, 201, 280, 282.1, 285, 286, 400, 5/411, 132, 663, 907, 922, 925
See application file for complete search history.

(56) References Cited

U.S. PATENT DOCUMENTS

| | | | | |
|---|---|---|---|---|
| 1,230,446 | A | 6/1917 | Thirlwall | |
| 2,763,875 | A * | 9/1956 | Piontkowski | 5/493 |
| 2,794,991 | A | 6/1957 | Gordon | |
| 3,205,514 | A | 9/1965 | Reynolds | |
| 3,242,507 | A * | 3/1966 | Peterson | 5/246 |
| 4,381,571 | A * | 5/1983 | Elliott | 5/616 |
| 4,589,151 | A * | 5/1986 | Behrens | 5/614 |
| 5,528,780 | A | 6/1996 | Taylor | |
| 5,542,137 | A | 8/1996 | Byfield | |
| 5,579,550 | A * | 12/1996 | Bathrick et al. | 5/620 |
| 5,687,437 | A * | 11/1997 | Goldsmith | 5/611 |
| 5,903,938 | A | 5/1999 | Padilla | |
| 6,006,379 | A * | 12/1999 | Hensley | 5/618 |
| 6,990,698 | B2 * | 1/2006 | Wall, Sr. | 5/618 |
| 7,017,202 | B1 | 3/2006 | Chisholm | |
| 7,930,780 | B2 * | 4/2011 | Clenet | 5/618 |

(Continued)

FOREIGN PATENT DOCUMENTS

| | | |
|---|---|---|
| CN | 201727176 | 2/2011 |
| WO | WO 2011/008265 | 1/2011 |

*Primary Examiner* — Michael Trettel
(74) *Attorney, Agent, or Firm* — Perkins Coie LLP

(57) ABSTRACT

The technology of the present application provides an adjustable bed having a stationary base and a shroud. The shroud may be provided in multiple pieces or a solitary strip of material. The shroud has a height sufficient to inhibit the view of the bottom of the adjustable bed. The shroud has either a plurality of protrusions or a plurality of receptacles. The stationary base conversely has a corresponding plurality of receptacles or a plurality of protrusions. The protrusions are sized to slidingly fit into the receptacles in a telescoping fashion. In one aspect, the shroud and stationary base have both protrusions and receptacles.

13 Claims, 8 Drawing Sheets

(56) References Cited

U.S. PATENT DOCUMENTS

| | | | | |
|---|---|---|---|---|
| 8,146,188 | B2 | 4/2012 | Hibler | |
| 8,407,834 | B1 | 4/2013 | Oh | |
| 2010/0175187 | A1 | 7/2010 | Hall | |
| 2011/0005000 | A1 | 1/2011 | Rippe et al. | |
| 2011/0138533 | A1 | 6/2011 | Rippe et al. | |
| 2013/0239328 | A1 | 9/2013 | Rose | |
| 2014/0250594 | A1 * | 9/2014 | Rawls-Meehan | 5/400 |

* cited by examiner

REPLACEABLE SHROUD FOR AN ADJUSTABLE BED

CROSS-REFERENCE TO RELATED PATENT APPLICATIONS

This application claims priority to U.S. Provisional Application No. 61/864,149, filed Aug. 9, 2013, and 61/921,671, filed Dec. 30, 2013, the entirety of which is hereby incorporated by reference as if set out in full.

BACKGROUND

Adjustable beds have existed for decades. Early beds were rudimentary, but provided therapeutic value. The modern adjustable bed originated with Dr. Willis Gatch in the early 20th century. The early adjustable bed provided for people to angulate a head or leg portion of the mattress with respect to the buttocks to provide a more customary and comfortable position for activities.

Unfortunately, despite being therapeutic and available, adjustable beds remain unsightly. Generally, an adjustable bed has a solid metal base on which the adjustable mattress moves. At best, the adjustable bed may have a singular outer metal finish or an exposed base.

Thus, against this background, it would be desirable to provide an adjustable bed with a shroud that could be changed.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

The technology of the present application provides an adjustable bed having a stationary base and a shroud. The shroud may be provided in multiple pieces or a solitary strip of material. The shroud has a height sufficient to inhibit the view of the bottom of the adjustable bed. The shroud has either a plurality of protrusions or a plurality of receptacles. The stationary base conversely has a corresponding plurality of receptacles or a plurality of protrusions. The protrusions are sized to slidingly fit into the receptacles in a telescoping fashion. In one aspect, the shroud and stationary base have both protrusions and receptacles.

In one aspect of the technology described herein, the protrusions and the receptacles have corresponding tapers. The protrusions frictionally engage the receptacles such that the shroud is removably coupled to the stationary base.

In certain aspects, the shroud may be mated to the frame using a fastener. The fastener may be a bore in the shroud that receives a threaded screw and a threaded bore in the frame. The threaded screw may be a thumb screw of the like.

In another aspect of the technology described herein, the protrusions may include a spring loaded detent and the receptacles may include a bore to receive the detent. The spring loaded detent and bore engage such that the shroud is removably coupled to the stationary base.

In still another aspect of the technology, at least one of the protrusions or receptacles may have a flexible tab with a shoulder and the other of the receptacle or protrusion may have a corresponding lip such that the flexible tab expands when the protrusion and receptacle are telescopically moved in relation to each other and snaps into a locked position when the shoulder aligns with the lip (or channel).

In yet another aspect of the technology, the shroud is modular or split along one or more areas such that multiple panels are attached. The multiple panels may be of various textures, fabrics, colors, and materials. The multiple panels may be designed with overlapping end portions to allow relative movement of the panels.

The technology of the present application also includes a mattress support surface cover. The mattress support surface cover may be of various textures, fabrics, colors, and materials and may be designed to match the shroud. The mattress support surface cover may be removably fitted to the mattress support surface. The mattress support surface cover should be stretchable or somewhat elastic, such as polymer fibers and the like, to move with the mattress support surface. The mattress support surface cover may include both woven and non-woven materials.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be explained with reference to the figures and drawings briefly outlined above. While the technology of the present application will be explained with particular reference to an adjustable bed, a person of ordinary skill in the art on reading the disclosure will now understand that the technology may be used in other devices, such as, for example, a conventional bed, furniture, or the like. Moreover, certain embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
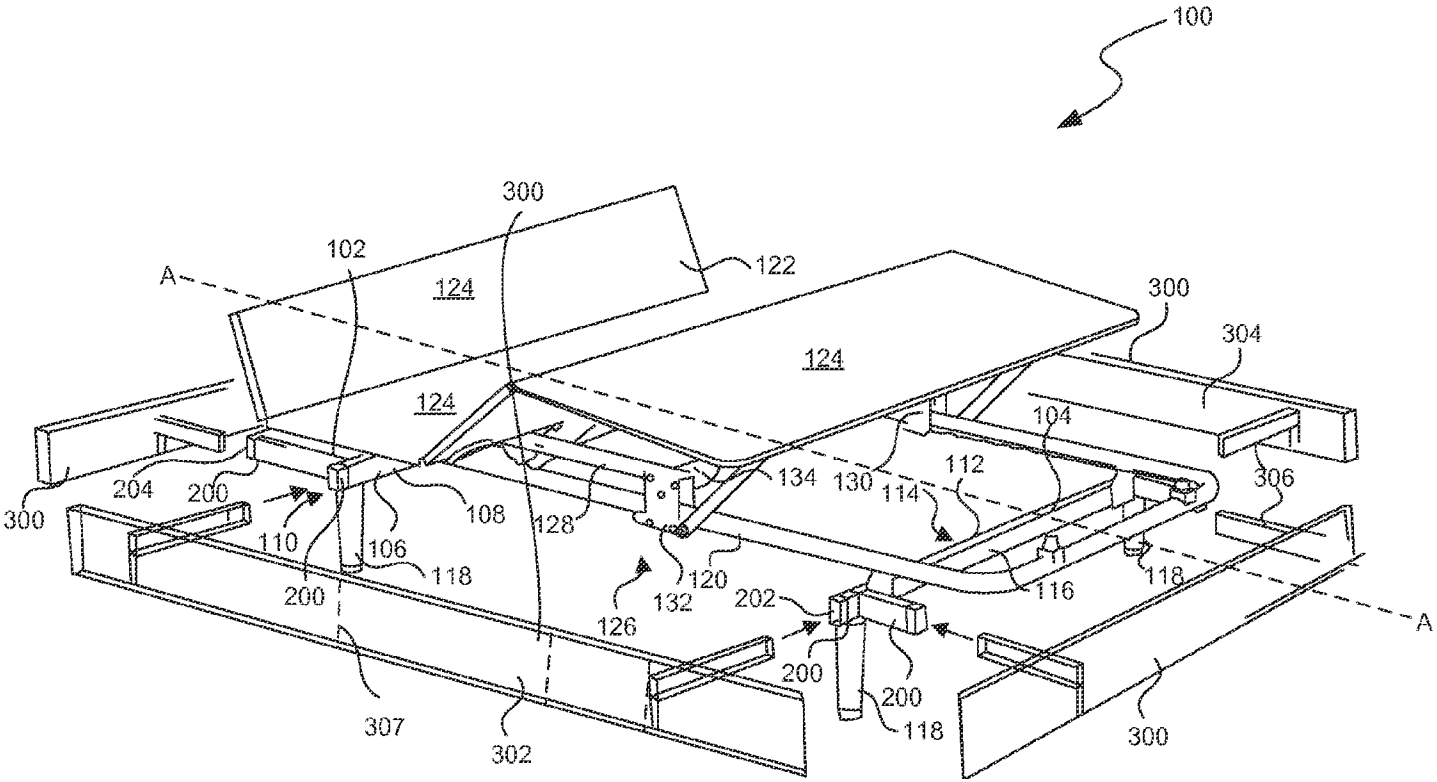
FIG. 1 depicts a partially exploded view of an adjustable bed consistent with the technology of the present application.

With reference now to FIG. 1, an adjustable bed 100 is provided. The adjustable bed 100 operation is generally well understood in the art and will be described herein only to the extent necessary for an understanding of the technology described herein. The adjustable bed 100 has a head stand 102 and a foot stand 104. The head stand 102 includes a head beam 106 having a foot facing side 108 and a head side 110 opposite the foot facing side 108. The head stand 102 traverses the long axis A of the adjustable bed 100. Similarly, the foot stand 104 comprises a foot beam 112 having a head facing side 114 opposed to foot facing side 108 and a foot side 116 opposite the head facing side 114.

A plurality of legs 118 extend from a bottom of the head and foot stands 102, 104. Fixedly coupled to the top of the head and foot stands 102, 104 is a tubular raceway 120. The tubular raceway 120 is stationary with respect to the head and foot stands 102, 104 and the head and foot stands 102, 104 together with the tubular raceway 120 may be considered a stationary base for the adjustable bed. The tubular raceway 120 may be replaced with alternative shapes. In this exemplary embodiment, the tubular raceway 120 generally outlines an outer edge of a mattress support surface 122 (which may sometimes be referred to as a deck, an adjustable bed deck, a mattress deck, or the like). The tubular raceway 120, however, may be discontinuous, modular, or the like. The mattress support surface 122 comprises a plurality of boards 124 that are moveable with respect to each other. The plurality of boards 124 may fold or unfold with respect to each other from a flat surface to support a supine individual, which is conventional for sleep surfaces, to the angled arrangement shown to support a seated individual with both head and legs raised with respect to the buttocks.

The mattress support surface 122 is movably coupled to the tubular raceway 120 through a moveable rail support 126. The moveable rail support 126 includes at least two rails 128 extending parallel to the long axis A of the bed. The rails 128 are on opposite sides of the long axis A of the adjustable bed 100 and generally aligned with a side of the adjustable bed 100. The rails 128 have legs 130 extending downward to a plurality of tubular sleeve members 132. The tubular sleeve members 132 are slidingly coupled to the tubular raceway 120. The tubular sleeve members 132 slide longitudinally along the tubular raceway 120. While shown as circular, tubular members, the shape of the raceway 120 and the sleeve members 132 may be alternative shapes as long as the shapes allow the sleeve members to slide longitudinally along the raceway 120. The rails 128 may be supported by cross support beams 134. Also, alternatively to the above sleeve movement system, the moveable rail support 126 may be provided with rollers or wheels that movably mate with a channel or groove in the tubular raceway 120 to allow the moveable rail support 126 to move with respect to the tubular raceway 120.

With continued reference to FIG. 1, the head and foot stands 102, 104 have extensions 200. The extensions 200, in this exemplary embodiment, are rectangular tubes typically made from a metal such as steel. The tubes may be hollow or they may have blind holes 202, which blind holes or hollow space may be referred to as receptacles as will be explained further below. The extensions 200 may have outer ends 204 about holes 202 that may be slightly larger (e.g., have a greater cross-sectional surface area) than the remainder of the extension 200. The larger outer ends 204 may facilitate receiving protrusions, which will be described below.

A plurality of removable shroud panels 300 are shown exploded from the adjustable bed 100 for convenience. The shroud panels 300 may be formed of fabric, foam, wood, metal, composites, a combination thereof, or the like. The shroud panels 300 have an outer face 302 and an inner face 304. Extending from the inner face 304 are a plurality of protrusions 306. The protrusions 306 are shaped to operatively connect into the holes 202, or receptacles. As shown, each of the plurality of removable shroud panels includes at least two protrusions 306, however, more or less protrusions are possible. Also, while four removable shroud panels 300 are shown, more or less shroud panels 300 are possible. For example, two "L-shaped" panels are possible. Alternatively, the shroud panels 300 may be segmented along the long sides to match the boards 124, the segmentations 307 are shown in phantom. In still another embodiment, the shroud panels 300 may be a single flexible panel that wraps around the adjustable bed 100. While designated as protrusions 306 and holes 202 in the present exemplary embodiment, the protrusions 306 may be considered in some embodiments a first extension 306 having a first socket part and the holes 202 may be considered in some embodiments a second extension 202 having a second socket part wherein the first socket part in this example is a male socket part and the second socket part in this example is a female socket part operatively sized to engage the male socket part. The protrusions may be chamfered to facilitate insertion of the male protrusions into the female sockets.

Figure 2:
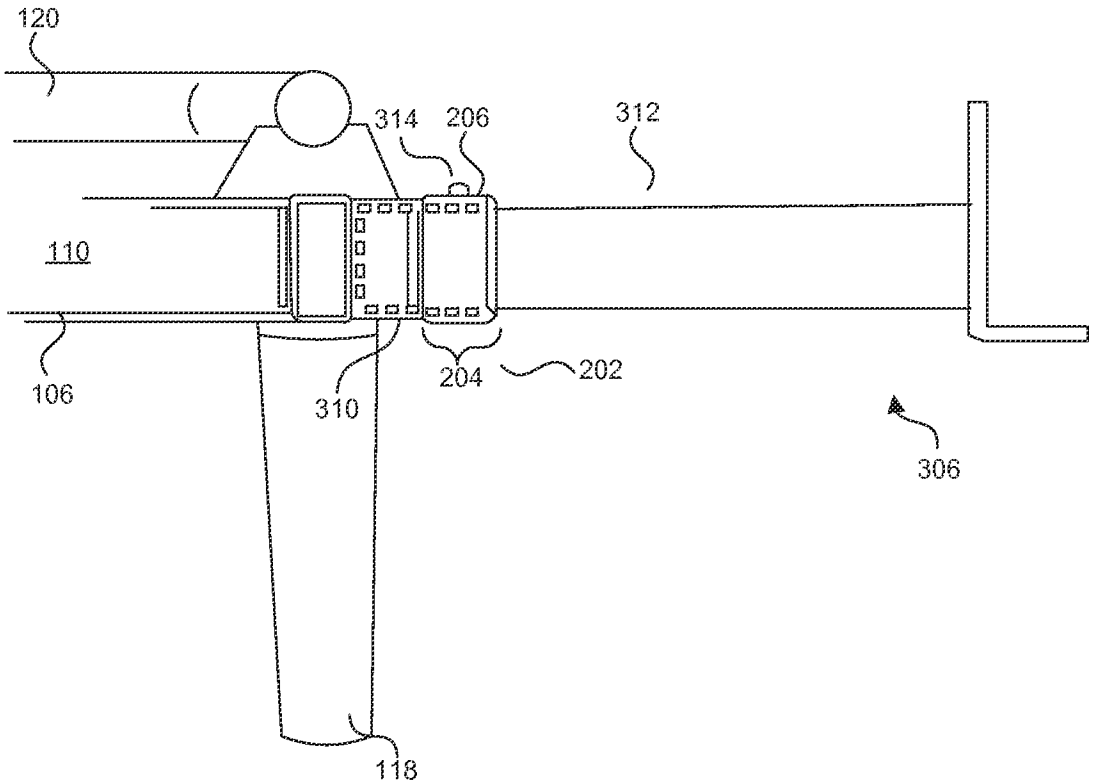
FIG. 2 depicts an elevation view of a connection consistent with the technology of the present application.

With reference now to FIG. 2, a detail of an exemplary connection between hole 202 and protrusion 306 is shown. The outer end 204 of the hole 202 is slightly enlarged to facilitate sliding protrusion 306 into hole 202. The protrusion 306 has an overlap portion 310 that fits into the hole 202 and a bracket arm 312 that extends to the panel 300. The overlap portion 310 is sufficiently long to resist the torque of the cantilever formed by the bracket arm and panel 300. The overlap portion also comprises a spring loaded ball 314. The spring loaded ball 314 is biased by a spring (not specifically shown) to extend out of the overlap portion 310 of the protrusion 306. The hole 202 has a detent 206 sized to operationally engage the spring loaded ball 314.

Figure 3:
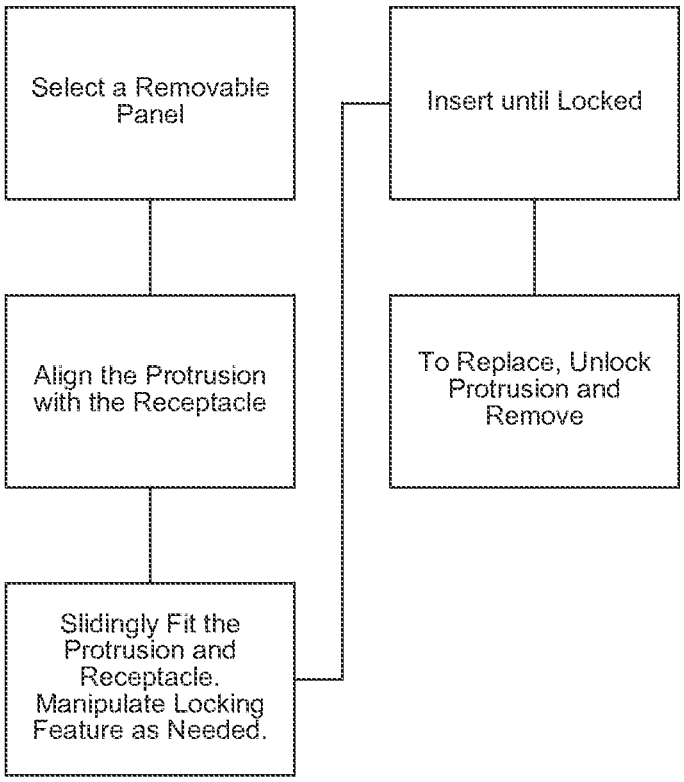
FIG. 3 depicts an exemplary method of using the technology of the present application.
Figure 4:
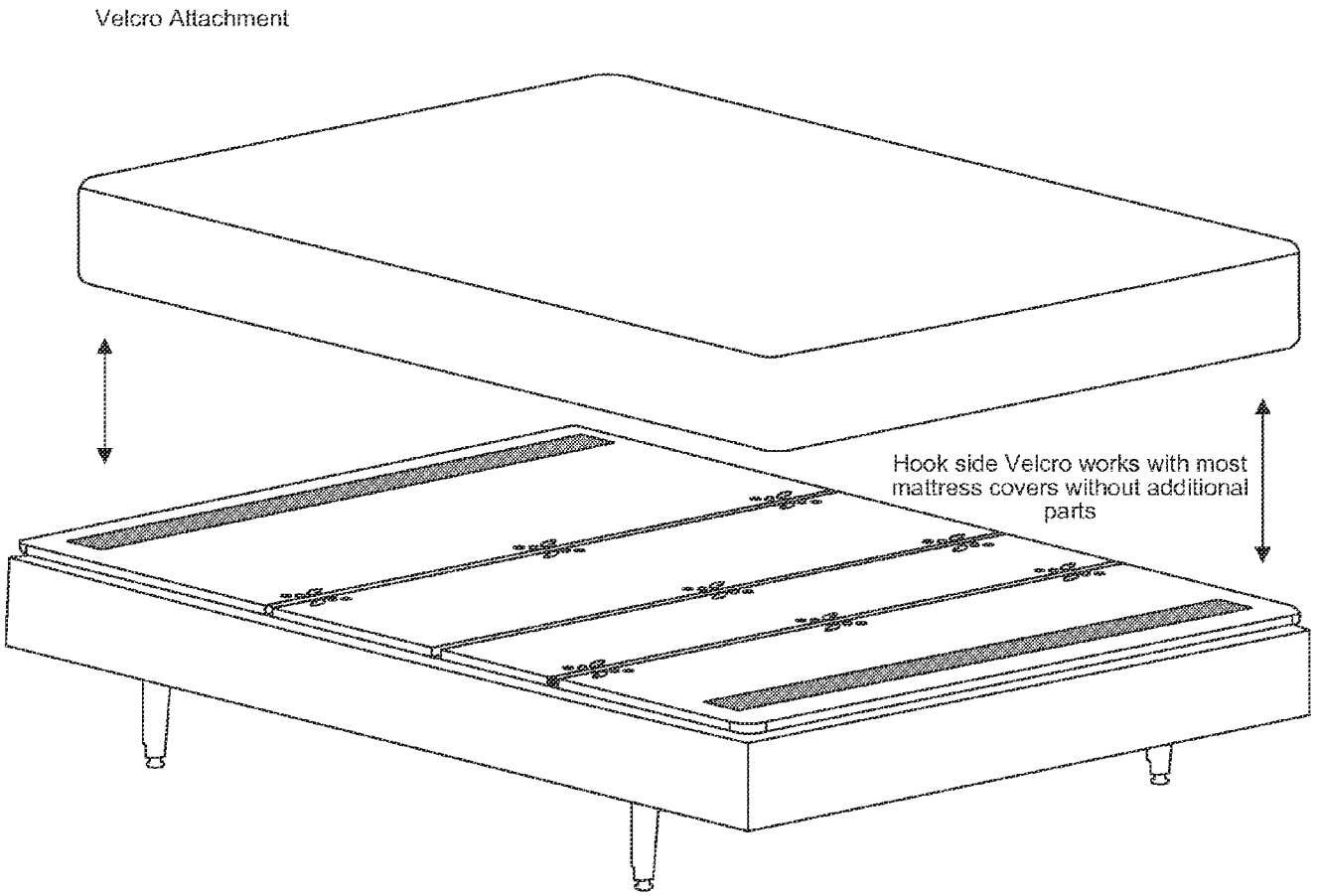
FIG. 4 depicts a side elevation view of an adjustable bed consistent with the technology of the present application.
Figure 5:
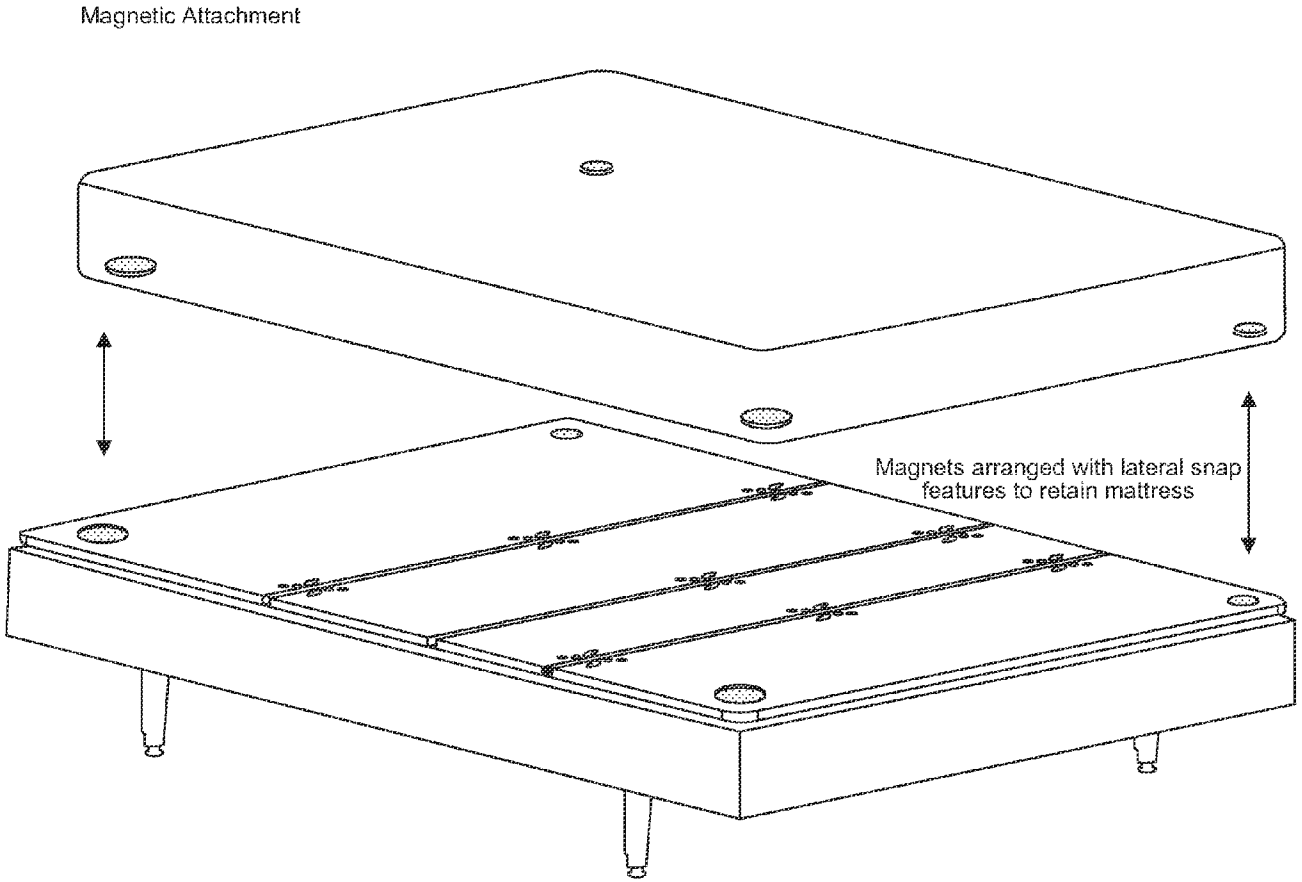
FIG. 5 depicts another side elevation view of an adjustable bed consistent with the technology of the present application.

With reference to FIG. 3, an exemplary method of using the technology of the present application is provided. The steps outlined for the present application provide for installing and removing a removable panel; however, the technology of the present application applies to installing, removing, replacing, or any combination thereof of the removable panels. First, a removable panel is selected for attachment to the adjustable bed. Next, the protrusion, especially the overlap portion, is aligned with a hole or receptacle. The protrusion is slidingly fitted into the outer end and the spring loaded ball is either depressed or forced to depress, by for example, a chamfered end, such that spring loaded ball travels within the hole. Alternatively, a locking mechanism is manipulated to allow the protrusion to fit with the receptacle. When the overlap portion is sufficiently inserted, the spring loaded ball springs to its original position into the detent of the hole locking the protrusion and panel in place. To remove the panel, the spring loaded ball is depressed, and the overlap portion is unlocked such that the protrusion may be slidingly removed from the hole and the panel removed or replaced.

Figure 6:
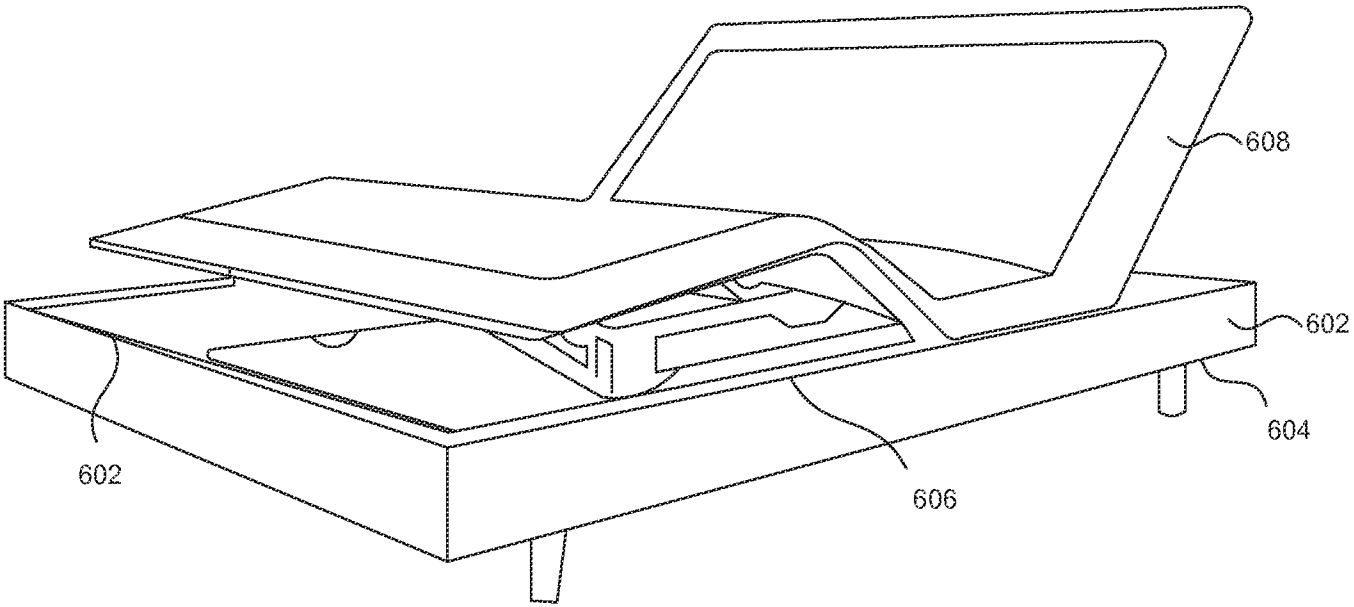
FIG. 6 depicts a perspective view of an adjustable bed consistent with the technology of the present application.
Figure 7:
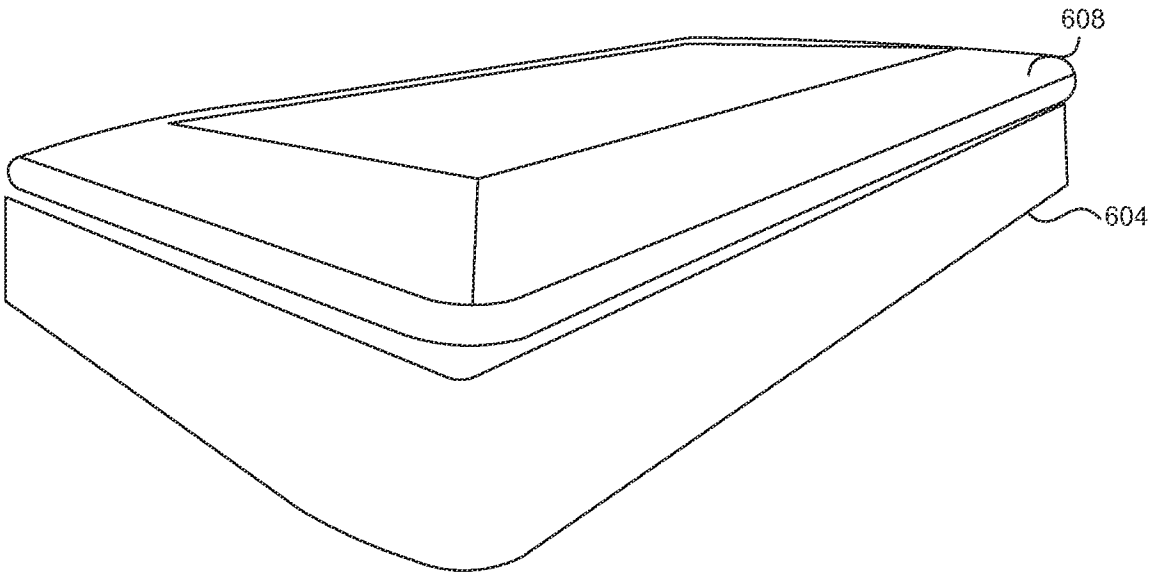
FIG. 7 depicts a perspective view of the adjustable bed of FIG. 6.

In certain embodiments, the shroud panel 300 and the bracket arm 312 may be a monolithic unit. In other embodiments, the shroud panel 300 is removable from the shroud bracket arm 312. When removable, the shroud panel 300 rests on the horizontal shelf 316 of the bracket arm 312 and is releasably coupled to the vertical wall 318, the horizontal shelf 316, or both of the bracket arm 312. The shroud panel 300 may be releasably coupled to the bracket arm 312 by hook and loop fasteners, set screws, thumb screws, or the like. Similarly, the shroud panel 300 may have a fabric layer monolithic with or removably attached to at least the outer face 302 of the shroud panel 300. If the fabric layer is removably attached to at least the outer face 302, the shroud panel 300 may have fasteners (not specifically shown) on the outer face 302 (or possibly on the bottom and top sides of the shroud panel 300 to hide the edges of the shroud panel 300). In this case, fabric layer would have a corresponding fastener to allow the fabric layer to be removably coupled to the outer face 302 of the shroud panel. Such corresponding fasteners may include hoop material at one location and corresponding loop material at a corresponding location. Alternatively such corresponding fasteners may include button snaps with a male member at one location and a female member at a corresponding location. While the removable fabric layer is described with a removable shroud panel 300, one of ordinary skill in the art on reading the disclosure would now recognize that the removable fabric layer could be used in conjunction with an adjustable bed frame having a non-removable panel surrounding the stationary frame base. In certain aspects, the fabric layer will be a single wrap of fabric that attaches to multiple panels and may wrap completely around the adjustable bed frame. Rather than fasteners to the outer face 302 of the shroud panel 300, the adjustable fabric may have elastics coupled to a seam or channel in the top and bottom edges of the fabric layer to envelope the shroud panel 300. In this case, fabric layer may include a leading and trailing portion that has one or more fasteners to either couple the fabric layer to the shroud panel 300 or couple the leading portion of a subsequent fabric layer to the trailing portion of a proceeding fabric layer As shown in FIGS. 6 and 7, an adjustable bed 600 may include a base frame 602 to which a removable shroud panel 604 is coupled. The adjustable bed 600 includes a mattress support surface 606 above the base frame 602 and shroud panel 604. The mattress support surface 606 may be covered by a mattress support surface cover 608. The mattress support surface cover 608 should be stretchable or elastic fabric. One exemplary fabric includes spandex, which is sometimes referred to as LYCRA®. However, any stretchable or elastic fabric, whether woven or non-woven, is acceptable. Providing a stretchable or elastic fabric for the mattress support surface cover 608 allows for the articulation of the support surface panels from a supine position (FIG. 7) to the articulated position (FIG. 6) while maintaining a reasonably tight fit between the mattress support surface 606 and the mattress support surface cover 608. The mattress support surface cover 608 may be a single piece of fabric or a multi-piece fabric as shown. As shown, the mattress support cover 608 includes an edge fabric 610 and a center fabric 612. The edge fabric 610 may be selected to match the shroud panel 604 while the center fabric 612 may be a rubberized fabric or the like to form a higher friction surface to inhibit the mattress (not shown) from moving. Notice, instead of having a single cover as shown, each panel of the mattress support surface 606 may instead have its own individual panel cover similar to the mattress support surface cover 608.

Figure 8:
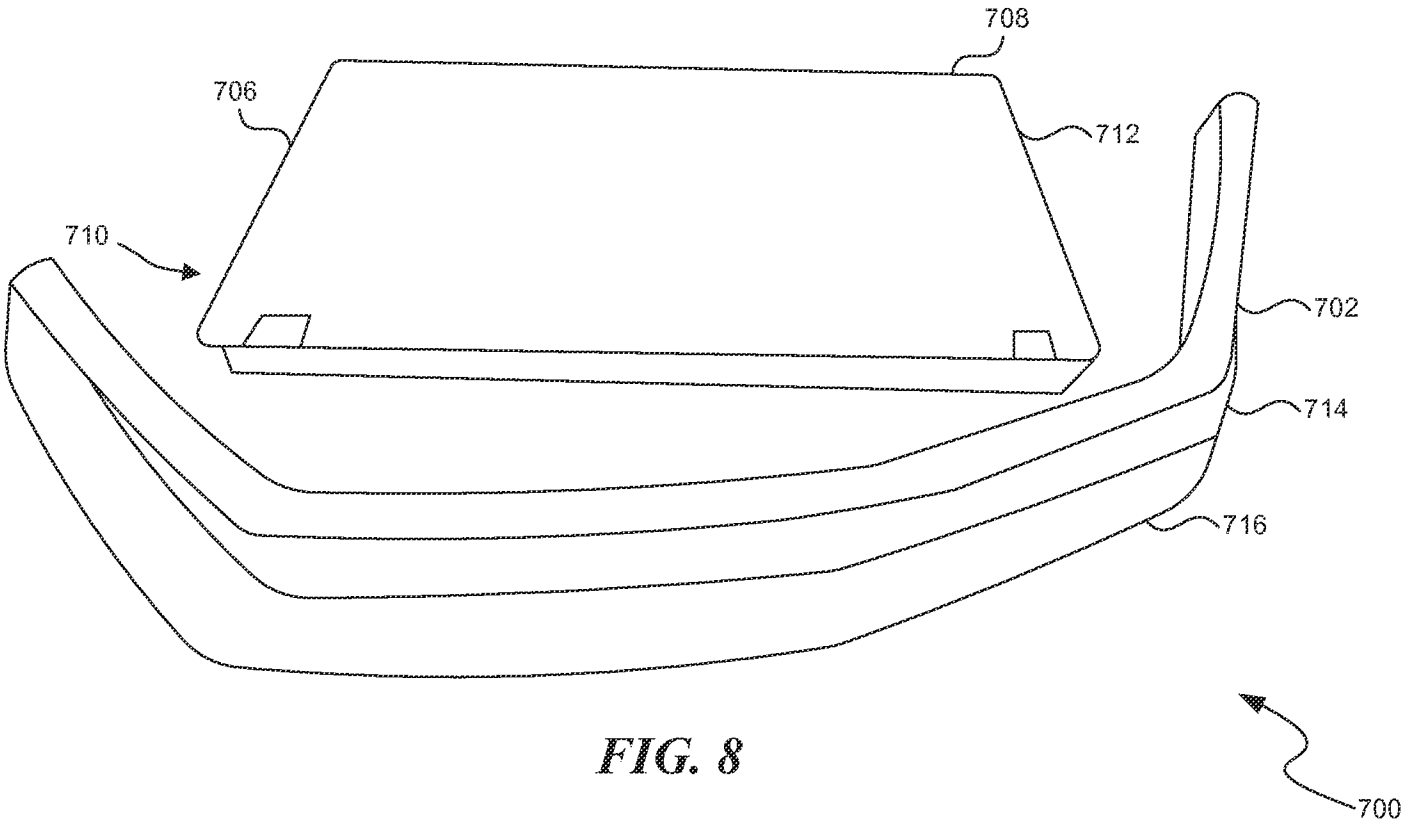
FIG. 8 depicts a view of a deck of the mattress support surface and a deck shroud consistent with the technology of the present application.

An alternative shroud panel 700 is shown in FIG. 8. The shroud panel 700 may include a deck shroud 702. The deck shroud 702, similar to the shroud above, may be a plurality of panels, a single panel, or the like. A single panel 704 of the deck shroud 702 is shown. In particular, the single panel 704 is formed to wrap around the ends (head or foot) of the mattress support surface. A deck 706 of the mattress support surface is shown as well, for example, the foot deck. The deck 706 is shown bottom side 708 up and the top side 710, on which the mattress rests, is opposite the bottom side 708. The deck shroud 702 may be releasably coupled to the deck 706 using one or more fasteners. For example, the bottom side 708 of the deck 706 may have a strip of hook material 712 and the deck shroud 702, on a top edge 714, may have corresponding loop material 716 such that the deck shroud 702 is releasably coupled to the bottom side 708 of the deck 706 by the hook and loop material. Other fasteners are possible such as, for example, snaps, zippers, adhesives, glues, or the like. The deck 706 will have a margin 716 that extends beyond the base frame (shown above). The strip of hook material 712 is aligned with the margin 716 such that the deck shroud 702 hangs down outside of the base frame. In operation, the deck shroud may cover gaps 718 that occur between the base frame and the deck or mattress support surface. In some embodiments, the shroud panels described above and the deck shroud 702 are used in conjunction.

While the above describes the connection between the removable panel and the head and foot stands to comprise a hole or receptacle in the stands and a protrusion from the panel, the reverse or a combination also is possible. Further, the above describes using a spring loaded ball (or pin) and detent locking arrangement between the protrusion and receptacle, but alternative connections are possible including, for example, a taper lock, a friction fitting, a spring tab or a tongue and groove connection.

Although the technology has been described in language that is specific to certain structures, materials, and methodological steps, it is to be understood that the technology will be defined in the appended claims is not necessarily limited to the specific structures, materials, and/or steps described. Rather, the specific aspects and steps are described as forms of implementing the claimed invention. Because many embodiments of the invention can be practiced without departing from the spirit and scope of the technology disclosed herein, the application technology resides in the claims hereinafter appended. Unless otherwise indicated, all numbers, orientations, or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. An adjustable bed having a stationary base and a mattress support surface that includes a plurality of panels wherein at least one of the plurality of panels is movable with respect to another of the plurality of panels, the adjustable bed further having a removable shroud removably coupled to the stationary base, the removable shroud comprising:

at least one shroud panel having an inner face and an outer face opposite the inner face and facing outwards from the stationary base; and a plurality of first extensions having a corresponding plurality of first socket parts coupled to the inner face of the at least one shroud panel and extending from the inner face towards the stationary base, wherein the plurality of first extensions are connectable with a plurality of second extensions having a corresponding plurality of second socket parts to receive the plurality of first socket parts such that the at least one shroud panel is removably coupled to the stationary base.

2. The adjustable bed of claim 1 wherein the at least one shroud panel comprises a plurality of shroud panels, wherein the plurality of shroud panels substantially surrounds the stationary base.

3. The adjustable bed of claim 2 wherein the plurality of shroud panels corresponds to the plurality of panels.

4. The adjustable bed of claim 1 wherein the plurality of first extensions comprise a part of a lock to lock the plurality of first extensions to the plurality of second extensions.

5. The adjustable bed of claim 4 wherein the part of the lock is a spring loaded ball.

6. The adjustable bed of claim 4 wherein the part of the lock is a detent.

7. The adjustable bed of claim 1 wherein the plurality of first socket parts are male protrusions and the plurality of second socket parts are female sockets sized to operatively receive the male protrusions.

8. The adjustable bed of claim 7 wherein the male protrusions are chamfered to facilitate insertion of the male protrusions into the female sockets.

9. The adjustable bed of claim 1 wherein the plurality of first extensions comprises a bracket arm comparing a horizontal shelf and a vertical wall wherein the at least one shroud panel rests on the horizontal shelf such that the inner face abuts the vertical wall, wherein the at least one shroud panel is removably coupled to the bracket arm by at least one fastener.

10. The adjustable bed of claim 9 wherein the at least one fastener is a thumb screw.

11. The adjustable bed of claim 9 wherein the at least one fastener is a hook and loop fastener.

12. The adjustable bed according to claim 1 wherein at least one elastic deck cover is coupled to at least one of the plurality of panels.

13. The adjustable bed according to claim 12 wherein the at least one elastic deck comprises a rubberized portion to inhibit movement of a mattress.

* * * * *